US010882708B2

(12) United States Patent
Suzuki

(10) Patent No.: US 10,882,708 B2
(45) Date of Patent: Jan. 5, 2021

(54) SHEET CONVEYANCE DEVICE, IMAGE FORMING APPARATUS, METHOD, AND STORAGE MEDIUM

(71) Applicant: CANON KABUSHIKI KAISHA, Tokyo (JP)

(72) Inventor: Yuta Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/860,318

(22) Filed: Apr. 28, 2020

(65) Prior Publication Data

US 2020/0354180 A1 Nov. 12, 2020

(30) Foreign Application Priority Data

May 10, 2019 (JP) ..... 2019-090164

(51) Int. Cl.

| | |
|---|---|
| ***B65H 5/38*** | (2006.01) |
| ***B65H 9/00*** | (2006.01) |
| ***B65H 5/06*** | (2006.01) |
| ***G03G 15/00*** | (2006.01) |

(52) U.S. Cl.

CPC ..... *B65H 5/38* (2013.01); *B65H 5/062* (2013.01); *B65H 9/006* (2013.01); *G03G 15/6558* (2013.01); *G03G 15/6561* (2013.01); *G03G 15/6567* (2013.01); *B65H 2301/5121* (2013.01);

(Continued)

(58) Field of Classification Search

CPC . B65H 5/00; B65H 5/062; B65H 5/36; B65H 5/38; B65H 9/004; B65H 9/006; B65H 29/70; B65H 2301/5121; B65H 2301/51212; B65H 2301/51214; B65H 2301/5122; B65H 2404/521; B65H 2404/74; B65H 2404/743; B65H 2404/7431; B65H 2511/242; B65H 2515/81; B65H 2515/842; B65H 2601/25;

(Continued)

(56) References Cited

U.S. PATENT DOCUMENTS

| | | | | |
|---|---|---|---|---|
| 10,747,148 | B1 * | 8/2020 | Oka | G03G 15/6535 |
| 2007/0231032 | A1 * | 10/2007 | Matsuno | G03G 15/6558 399/388 |
| 2017/0315490 | A1 * | 11/2017 | Nakamura | G03G 15/16 |

(Continued)

FOREIGN PATENT DOCUMENTS

JP 2006-189667 A 7/2006

*Primary Examiner* — Prasad V Gokhale

(74) *Attorney, Agent, or Firm* — Canon U.S.A., Inc. I.P. Division

(57) ABSTRACT

A sheet conveyance device includes a conveyance roller pair to convey a sheet, a skew correction roller pair to correct a skew of the sheet in a state in which the skew correction roller pair is being stopped, first and second conveyance guides, and a protrusion. The first conveyance guide includes a bend contact portion to come into contact with a portion forming a bend on the first surface of the sheet. The second conveyance guides the sheet. The protrusion is disposed between the skew correction roller pair and the bend contact portion to come into contact with the first surface of the sheet. The protrusion protrudes toward the second conveyance guide from the first conveyance guide in a manner as to intersect with a straight line connecting two nip portions and the bend contact portion in a cross section perpendicular to a width direction.

8 Claims, 9 Drawing Sheets

(52) U.S. Cl.
CPC ..... *B65H 2404/7431* (2013.01); *B65H 2511/242* (2013.01); *B65H 2515/842* (2013.01)

(58) Field of Classification Search
CPC ..... G03G 15/6558; G03G 15/6561; G03G 15/6567
See application file for complete search history.

(56) References Cited

U.S. PATENT DOCUMENTS

| | | | | |
|---|---|---|---|---|
| 2019/0064718 | A1* | 2/2019 | Mitsui | G01B 11/105 |
| 2019/0092592 | A1* | 3/2019 | Suzuki | B65H 7/06 |

* cited by examiner

SHEET CONVEYANCE DEVICE, IMAGE FORMING APPARATUS, METHOD, AND STORAGE MEDIUM

BACKGROUND

Field

The present disclosure relates to a sheet conveyance device that conveys a sheet and an image forming apparatus including the sheet conveyance device.

Description of the Related Art

Among sheet conveyance devices, some are designed to cause a leading end of a sheet to come into contact with a nip portion of a registration roller pair being stopped to warp the sheet, to correct a skew of the leading end of the sheet. Japanese Patent Application Laid-Open No. 2006-189667 discusses a configuration in which a bend portion is disposed in a conveyance path between a registration roller pair and a secondary transfer unit. The bend portion bends a sheet and guides the bent sheet. A registration roller pair that has a plurality of nip portions disposed apart from each other in a direction perpendicular to a sheet conveyance direction is known. A device may include the registration roller pair that has the plurality of nip portions disposed apart from each other in the sheet width direction. If a leading end of a sheet comes into contact with nip portions of a registration pair being stopped, a wave may occurs in the sheet between the plurality of nip portions in a width direction. In such a case, if the sheet having the wave passes a bend portion disposed downstream from the registration roller pair, wrinkles may be formed in the sheet.

SUMMARY

The present disclosure is directed to a sheet conveyance device by which formation of wrinkles in a sheet can be reduced.

According to an aspect of the present disclosure, a sheet conveyance device includes a conveyance roller pair configured to convey a sheet, a skew correction roller pair, disposed downstream from the conveyance roller pair in a sheet conveyance direction, wherein the skew correction roller pair is configured to form two nip portions disposed apart from each other in a width direction perpendicular to the sheet conveyance direction, and is configured to convey the sheet after a leading end of the conveyed sheet comes into contact with the two nip portions by the conveyance roller pair and a skew of the sheet is corrected in a state in which the skew correction roller pair is being stopped, a transfer unit disposed downstream from the skew correction roller pair in the sheet conveyance direction and configured to transfer a toner image on the sheet and convey the sheet on which the toner image has been transferred, a first conveyance guide, disposed between the skew correction roller pair and the transfer unit, wherein the first conveyance guide is configured to bend the sheet such that a first surface of the sheet becomes an inside surface, and wherein the first conveyance guide includes a bend contact portion configured to come into contact with a portion forming a bend on the first surface of the sheet, a second conveyance guide disposed in a position facing the first conveyance guide and configured to bend the sheet with the first conveyance guide to cause the first surface of the sheet to be the inside surface such that a second surface opposite the first surface of the sheet is an outside surface, and a protrusion disposed between the skew correction roller pair and the bend contact portion and configured to come into contact with the first surface of the sheet, wherein the protrusion is disposed in an entire area between the two nip portions of the skew correction roller pair in the width direction, and wherein the protrusion protrudes toward the second conveyance guide from the first conveyance guide in a manner as to intersect with a straight line connecting the two nip portions and the bend contact portion in a cross section perpendicular to the width direction.

According to the present disclosure, formation of wrinkles in a sheet can be reduced.

Further features of the present disclosure will become apparent from the following description of exemplary embodiments with reference to the attached drawings.

DESCRIPTION OF THE EMBODIMENTS

Hereinafter, a first exemplary embodiment is described in detail with reference to the drawings.

<Image Forming Apparatus>

Figure 1:
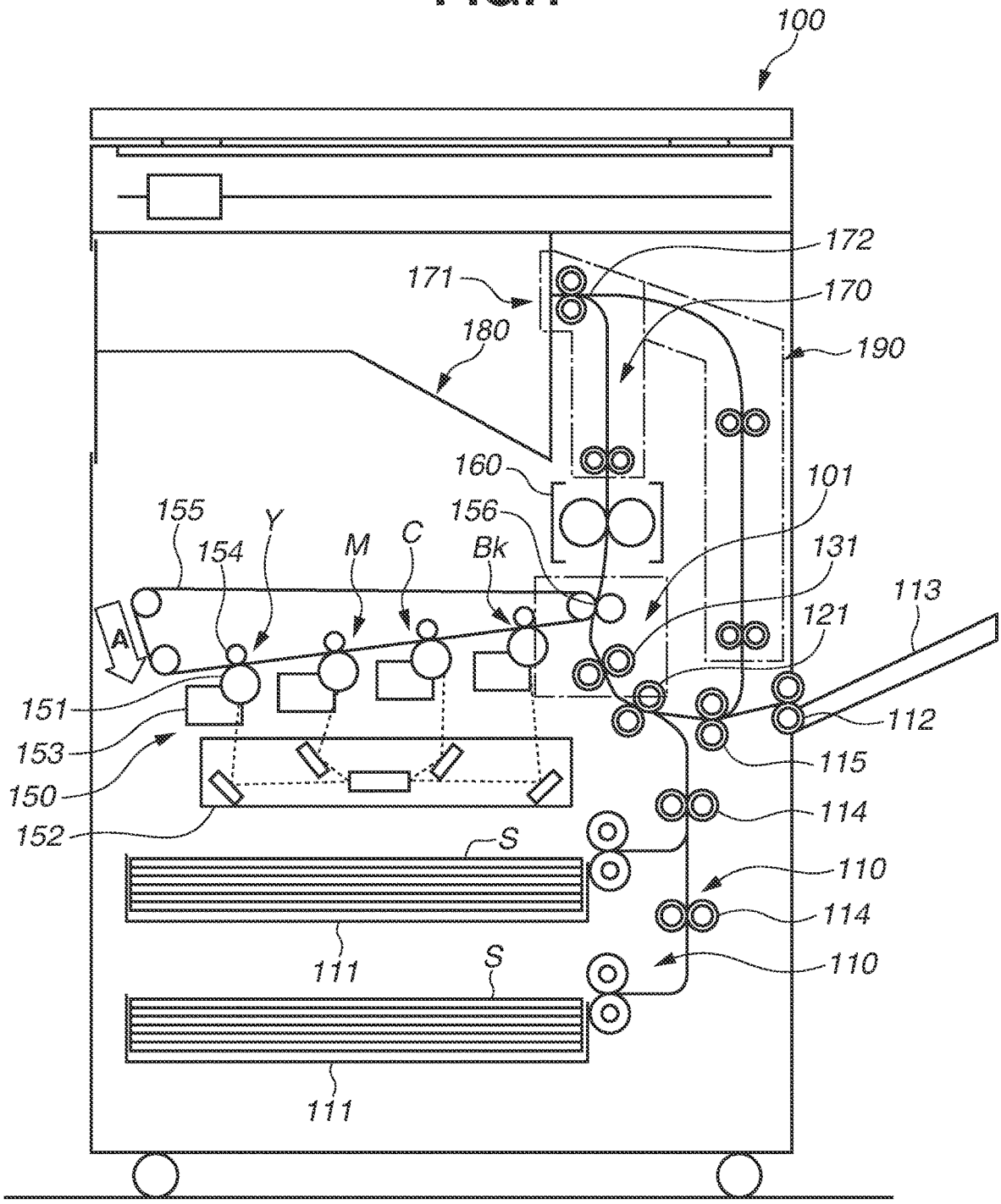
FIG. 1 is a sectional view of an image forming apparatus including a sheet conveyance device according to an exemplary embodiment.

FIG. 1 is a schematic sectional view of an image forming apparatus 100 including a sheet conveyance device 101 according to the exemplary embodiment.

In the image forming apparatus 100, image data transmitted from an external connection cable (not illustrated) is processed by a control unit (not illustrated). In response to a signal based on a result of the process, a laser scanner 152 emits a laser beam to form an electrostatic latent image on a photosensitive drum 151 as an image bearing member. Then, a developing device 153 develops the electrostatic latent image on the photosensitive drum 151, to form a toner image on the photosensitive drum 151. Subsequently, a primary transfer device 154 applies a predetermined pressure and an electrostatic load bias to transfer the toner image to an intermediate transfer belt 155. In FIG. 1, four image forming units 150 for yellow (Y), magenta (M), cyan (C), and black (Bk) are disposed.

Next, the intermediate transfer belt 155 is described. The intermediate transfer belt 155 is stretched by a plurality of rollers disposed on an inner circumferential surface side of the intermediate transfer belt 155, and is rotated in a direction indicated by an arrow A illustrated in FIG. 1. Accordingly, each of the aforementioned image forming units 150 for Y, M, C, and Bk performs processing in a parallel manner. An image forming process of each color is performed at a timing of when a toner image is superimposed on an upstream toner image primarily transferred to the intermediate transfer belt 155. Accordingly, a full color toner image is eventually formed on the intermediate transfer belt 155, and the full color toner image is conveyed to a secondary transfer unit 156.

Meanwhile, sheets S stacked on a sheet cassette 111 are separated and fed one by one by a sheet feed unit 110. A sheet drawing roller pair 114 and a pre-registration conveyance roller pair 121 as a conveyance roller pair convey the fed sheet S toward a registration roller pair 131 being stopped. The registration roller pair 131 serves as a skew correction roller pair, and is disposed on a downstream side in a sheet conveyance direction. Then, a leading end of the sheet S comes into contact with a nip portions 131*c* of the registration roller pair 131 being stopped to form a warp in the sheet S, whereby a skew of the sheet S is corrected. Subsequently, the sheet S is conveyed to the secondary transfer unit 156 by rotation of the registration roller pair 131. The secondary transfer unit 156 is a transfer unit that transfers a toner image to a sheet and conveys the sheet with the transferred image.

By the sheet conveyance process and the image forming process separately described above, the full color toner image is secondarily transferred to the sheet S in the secondary transfer unit 156. Then, the sheet S is conveyed to a fixing device 160. The fixing device 160 fixes the toner on the sheet S by applying a predetermined pressing force and a heating effect. The predetermined pressing force is generated by components such as rollers or belts that are disposed substantially opposite each other, and the heating effect is generally provided by a heat source such as a heater. The sheet S with the fixed image passes a post-fixing conveyance unit 170, and is stacked on a sheet discharge tray 180 provided in the image forming apparatus 100 by a sheet discharge device 171 while being aligned.

In some cases, two-sided image formation may be necessary. In such a case, when the leading end of the sheet S is once discharged on the sheet discharge tray 180 and a trailing end of the sheet S passes a branching position 172, the sheet S is switched back and conveyed to a reverse conveyance device 190. The sheet S conveyed to the reverse conveyance device 190 is sequentially conveyed to a drawing roller pair 115 and the pre-registration conveyance roller pair 121 by the reverse conveyance device 190, and then is conveyed toward the registration roller pair 131 as the skew correction roller pair provided on a downstream side in the sheet conveyance direction. After a skew of the sheet S is corrected by the registration roller pair 131, the sheet S is conveyed to the secondary transfer unit 156, and a toner image is transferred to a second surface of the sheet S. Subsequent to the transfer of the toner image to the second surface of the sheet S, the sheet S passes the fixing device 160 and the post-fixing conveyance unit 170, and is discharged to the sheet discharge tray 180 by the sheet discharge device 171 as described above.

A manual sheet feed tray 113 is disposed on a side surface of the image forming apparatus 100 in terms of feeding the sheet S. The sheet S stacked on the manual sheet feed tray 113 is conveyed by a manual sheet feed roller pair 112, and then is conveyed by the drawing roller pair 115 and the pre-registration conveyance roller pair 121 disposed on a downstream in the sheet conveyance direction to the registration roller pair 131 as the skew correction roller pair.

<Sheet Conveyance Device>

Figure 2:
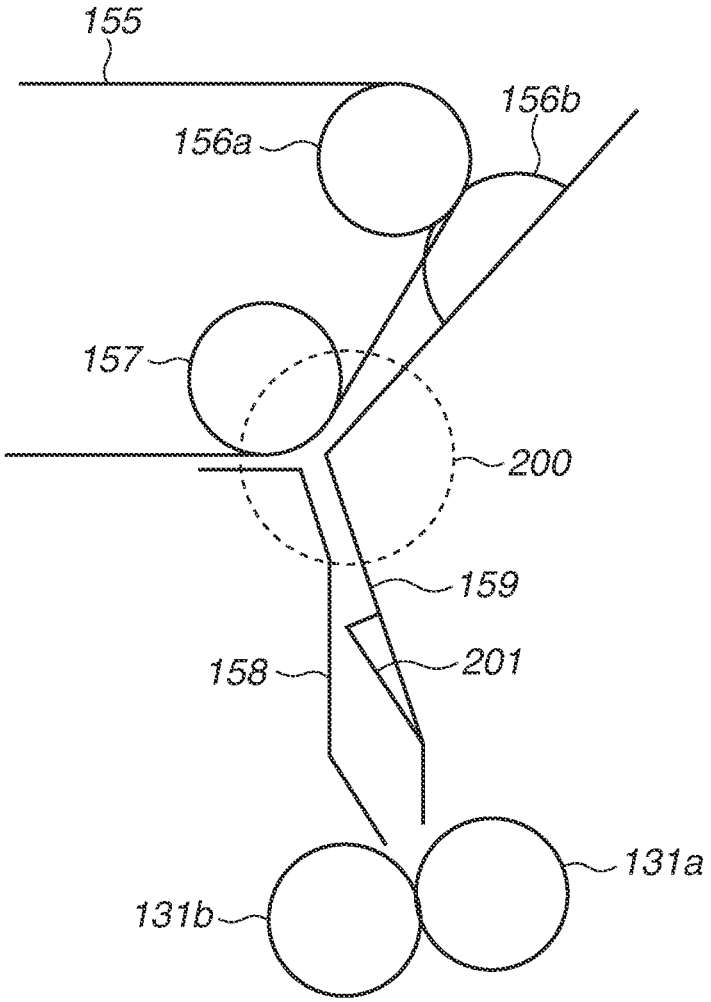
FIG. 2 is a sectional view of a sheet conveyance device in a first exemplary embodiment.
Figure 3:
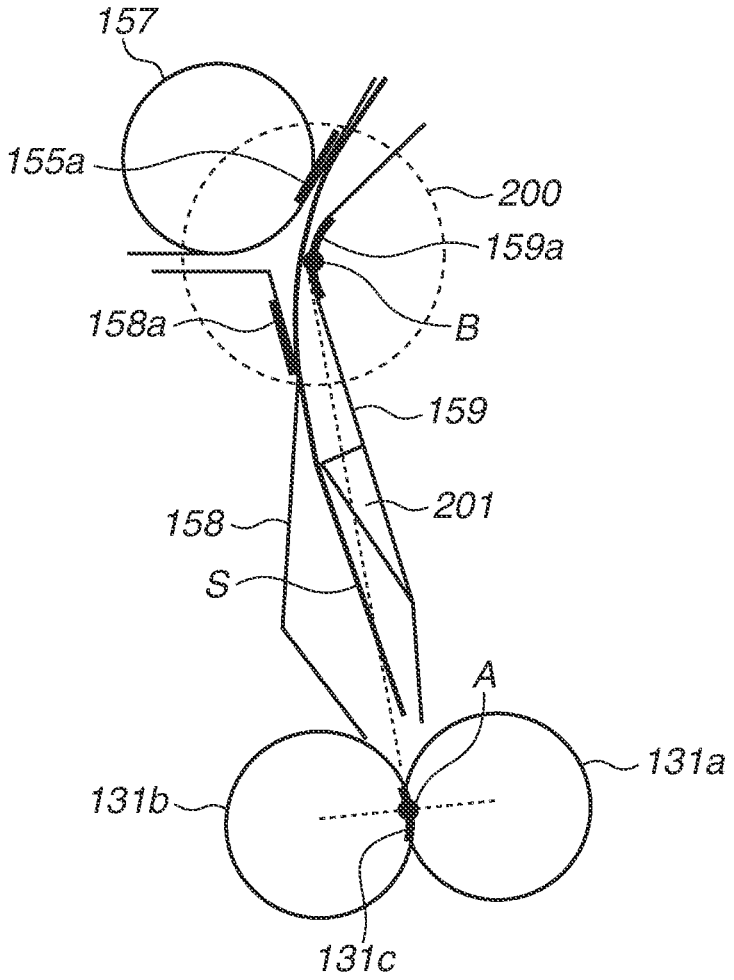
FIG. 3 is a sectional view of the sheet conveyance device in the first exemplary embodiment.
Figure 4:
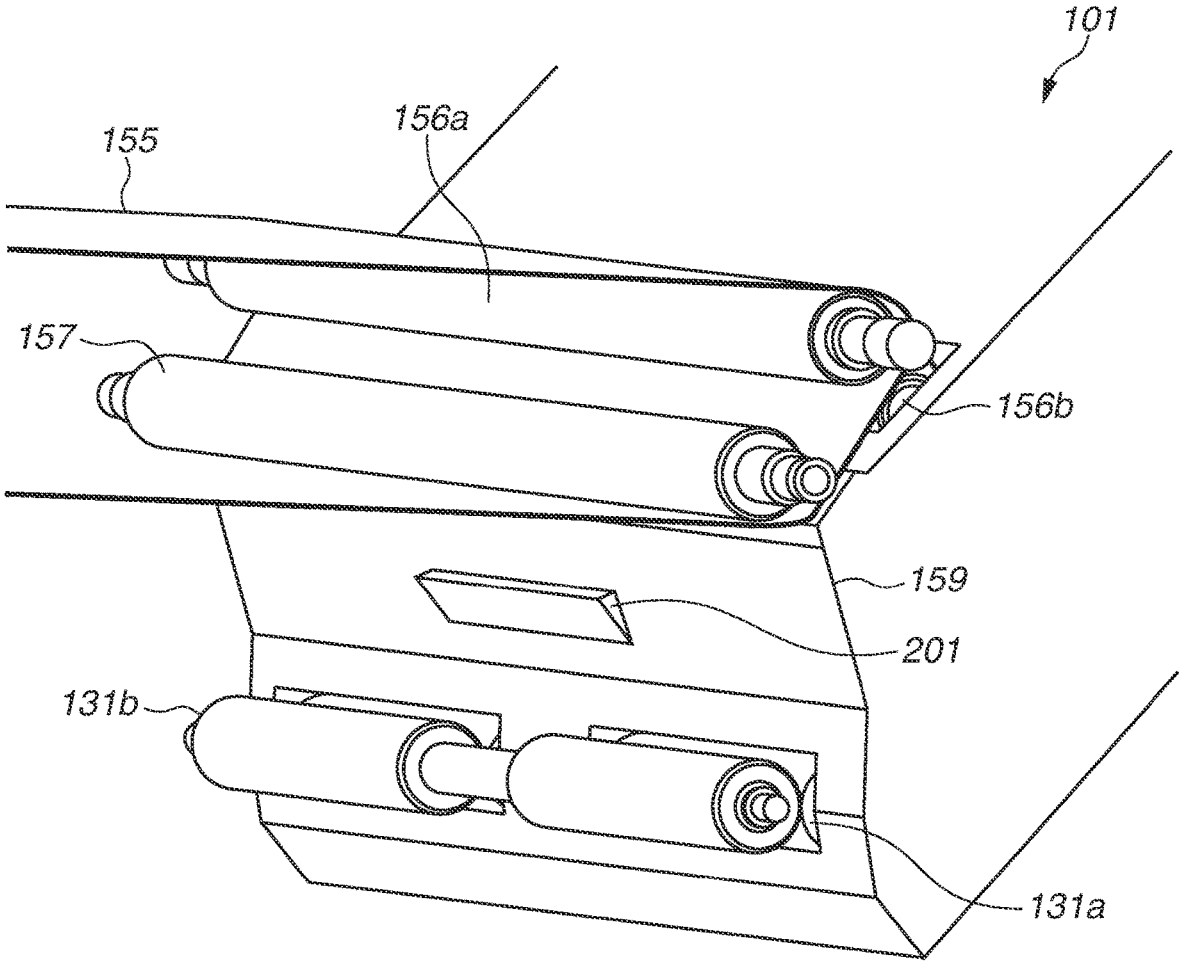
FIG. 4 is a perspective view of the sheet conveyance device as seen from a front left side in the first exemplary embodiment.

Next, the sheet conveyance device 101 according to the first exemplary embodiment is described with reference to FIGS. 2, 3, and 4. FIG. 2 is an enlarged sectional view of the sheet conveyance device 101 illustrated in FIG. 1, and FIG. 3 is an enlarged sectional view of a bend portion illustrated in FIG. 2. FIG. 4 is a perspective view of the sheet conveyance device 101.

The sheet conveyance device 101 includes the registration roller pair 131 and the secondary transfer unit 156. The registration roller pair 131 includes a registration drive roller 131*a* that is rotated by a component such as a motor (not illustrated), and a registration driven roller 131*b* that is rotated with rotation of the registration drive roller 131*a*. The registration drive roller 131*a* is disposed opposite the registration driven roller 131*b*. The registration driven roller 131*b* is pressed toward the registration drive roller 131*a*. The registration roller pair 131 forms two nip portions 131*c* that are disposed apart in a direction perpendicular to the sheet conveyance direction. The registration driven roller 131*b* is urged toward the registration drive roller 131*a* by a bearing (not illustrated) and a spring (not illustrated), in both end portions of a shaft and also between the nip portions 131*c*.

Since the registration drive roller 131*a* is expected to have a function of conveying the sheet S by a friction force, an elastic material such as rubber and silicone is mainly used for the registration drive roller 131*a*. Meanwhile, the leading end of the sheet S conveyed by the pre-registration conveyance roller pair 121 comes into contact with the registration driven roller 131*b*, a metal shaft or a resin material having good slidability is mainly used for the registration driven roller 131*b* so that the leading end of the sheet is guided by the registration roller pair 131.

The sheet S conveyed by the pre-registration conveyance roller pair 121 comes into contact with the registration roller pair 131 being stopped, and therefore a skew of the sheet S is corrected. A bend outer guide 158 as a second conveyance guide and a bend inner guide 159 as a first conveyance guide positioned opposite the bend outer guide 158 are disposed such that the sheet S is guided along the bend outer guide 158 and the bend inner guide 159 to the secondary transfer unit 156 subsequent to the skew correction. A bend portion 200 is disposed inside a sheet conveyance path. The bend portion 200 is formed by a first guide contact portion 158*a* of the bend outer guide 158, a bend contact portion 159*a* of the bend inner guide 159, and a belt contact portion 155*a* of the intermediate transfer belt 155. The bend contact portion 159*a* is disposed between the registration roller pair 131 and the secondary transfer unit 156. The first guide contact portion 158*a* is disposed on an upstream side of the bend contact portion 159*a* in the sheet conveyance direction, and a second guide contact portion (belt contact portion 155*a*) is disposed on a downstream side of the bend contact portion 159*a*. The sheet S being conveyed is conveyed while contacting the first guide contact portion 158*a*, the bend contact portion 159*a*, and the belt contact portion 155*a*, and therefore stable sheet behavior to the secondary transfer unit 156 is ensured. That is, the sheet S conveyed by the registration roller pair 131 is bent in the above-described bend portion 200, whereby a stable sheet orientation is maintained in the secondary transfer unit 156. In the bend portion 200, the sheet S is bent such that a first surface of the sheet S facing the bend inner guide 159 becomes an inside surface by the bending. That is, the bend inner guide 159 is disposed on a side near the curvature center of a bent portion of the sheet S. Meanwhile, the sheet S has the second surface that is an opposite side of the first surface and faces the bend outer guide 158. That is, when the sheet S is bent, the first surface of the sheet S becomes an inside surface, and the second surface of the sheet S becomes an outside surface. The first surface of the sheet S comes into contact with the bend contact portion 159*a*, whereas the second surface of the sheet comes into contact with the first guide contact portion 158*a* and the belt contact portion 155*a*.

In the present exemplary embodiment, on an upstream side of the bend portion 200 in the sheet conveyance direction, a protrusion 201 is disposed on the bend inner guide 159. In a cross section perpendicular to a width direction as illustrated in FIG. 3, the protrusion 201 protrudes toward the bend outer guide 158 from the bend inner guide 159 such that the protrusion 201 intersects with a straight line connecting the nip portions 131*c* of the registration roller pair 131 and the bend contact portion 159*a*. Two points on the straight line connecting the nip portions 131*c* and the bend contact portion 159*a* are set as follows. An intersection point A is an intersection of a straight line connecting the rotation center of the registration drive roller 131*a* and the rotation center of the registration driven roller 131*b* with an outside diameter of the registration driven roller 131*b*. An intersection point B is an intersection of the bend contact portion 159*a* with a straight line extending from the intersection point A and contacting the bend contact portion 159*a* in the bend inner guide 159. Since the sheet S is bent in the bend portion 200, the straight line connecting the two points that are the nip portions and the bend contact portion 159*a* as a point in which the sheet P is bent is set.

As illustrated in FIG. 4, a position of the protrusion 201 in the width direction is disposed in an inside and also a middle portion of an image area in which an image is formed on a sheet in the secondary transfer secondary unit. More specifically, between the two nip portions in the width direction of the registration roller pair 131, at least a part of the protrusion 201 is formed in an area corresponding to the sheet conveyance direction.

After the sheet S passes the bend portion 200 by the registration roller pair 131 rotated in synchronization with the leading end of a toner image, the sheet S is guided along the intermediate transfer belt 155 to the secondary transfer unit 156. The secondary transfer unit 156 includes a secondary transfer drive roller 156*a* that rotates to circulate the intermediate transfer belt 155, and a secondary transfer driven roller 156*b* urged to the secondary transfer drive roller 156*a* by a member such as a spring. The secondary transfer drive roller 156*a* is disposed opposite the secondary transfer driven roller 156*b*.

<Sheet Behavior in the Present Exemplary Embodiment>

Next, a description is given of a wave in the sheet S that occurs between the nips of the registration roller pair in the present exemplary embodiment. The sheet S nipped and conveyed by the registration roller pair 131 is guided by the bend outer guide 158 and the bend inner guide 159, and accordingly conveyed to the bend portion 200. If the sheet S is conveyed to the registration roller pair 131 in a skewed orientation due to a reason, for example, the sheet S has been set in the sheet cassette 111 in a tilt manner, a wave can occur in the sheet S between the roller nips of the registration roller pair 131 when the skew is corrected.

Figure 5B:
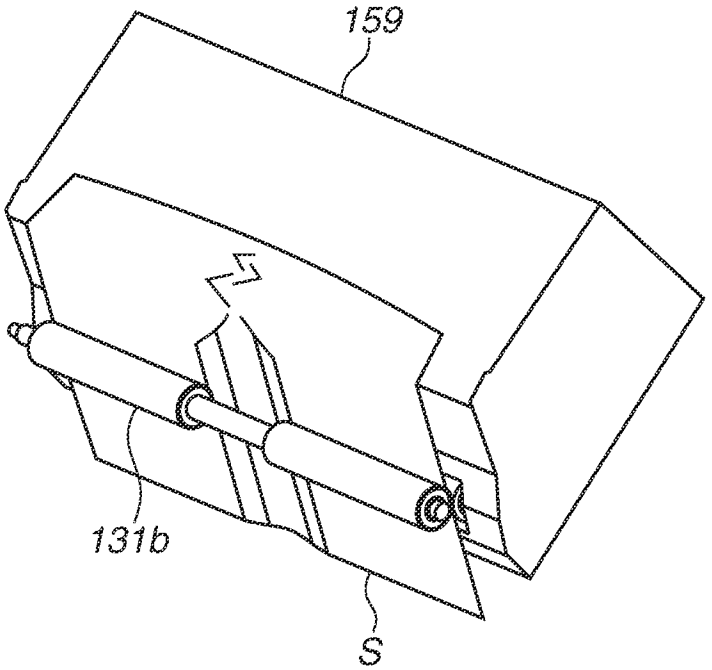
FIGS. 5A and 5B are diagrams each illustrating a state in which a wave crest occurring in a skew-corrected sheet is formed toward a bend inner side of a bend portion in the first exemplary embodiment.
Figure 5A:
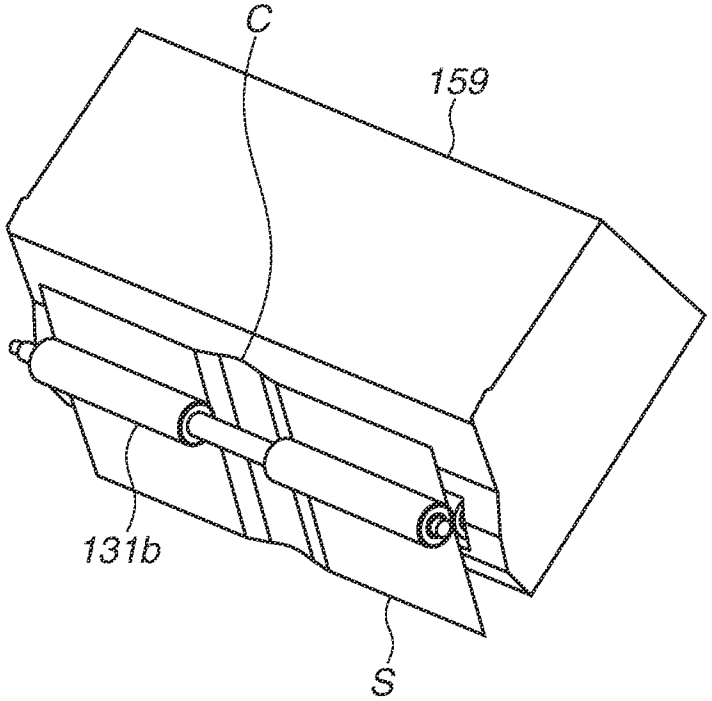
Figure 6B:
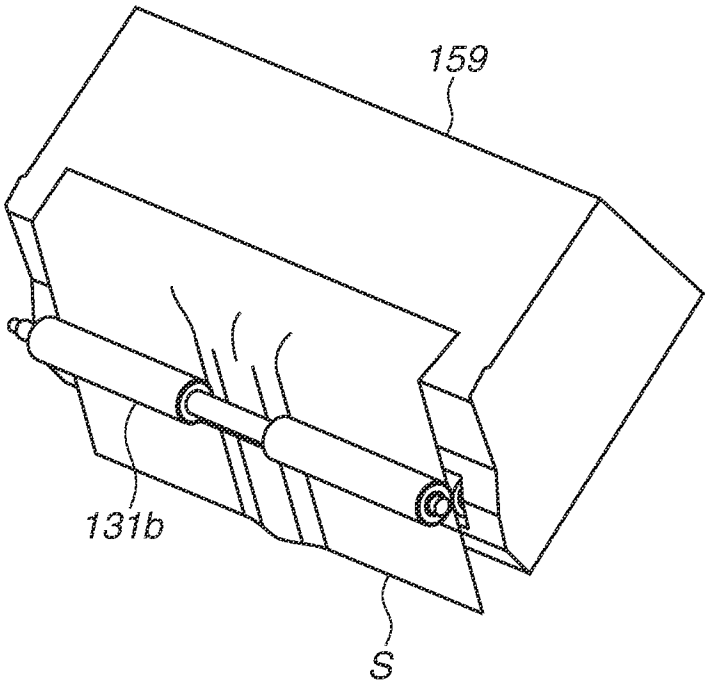
FIGS. 6A and 6B are diagrams each illustrating a state in which a wave crest occurring in a skew-corrected sheet is formed toward a bend outer side of a bend portion in the first exemplary embodiment.
Figure 6A:
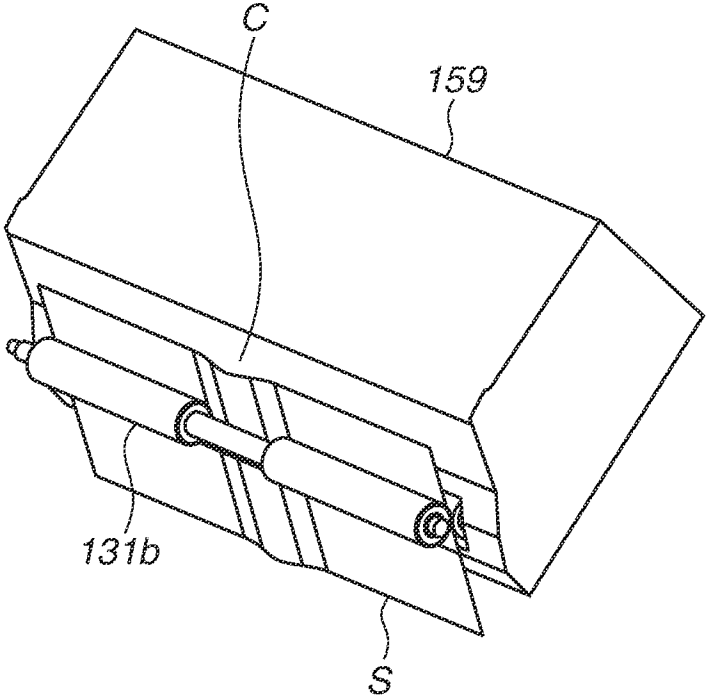

Herein, a wrinkle that is formed when the waved sheet S passes the bend portion 200 is described. A wave occurring in the sheet S can be a wave crest C toward the bend inner guide 159 as illustrated in FIG. 5A, or a wave crest C toward the bend outer guide 158 as illustrated in FIG. 6A. Further, waves occurring in the sheet S can have wave crests toward both of the bend inner guide 159 and the bend outer guide 158. In a case in which a protruding portion such as the protrusion 201 according to the present exemplary embodiment is not disposed, and a wave occurring in the sheet S has the wave crest C toward the bend inner guide 159 as illustrated in FIG. 5A, the sheet S cannot be bent along the bend portion 200, and wrinkles are formed as illustrated in FIG. 5B. In a case in which a wave occurring in the sheet S is the wave crest C toward the bend outer guide 158 as illustrated in FIG. 6A, the sheet S can be bent along the bend portion 200, and is conveyed without forming a wrinkle as illustrated in FIG. 6B.

Figure 7A:
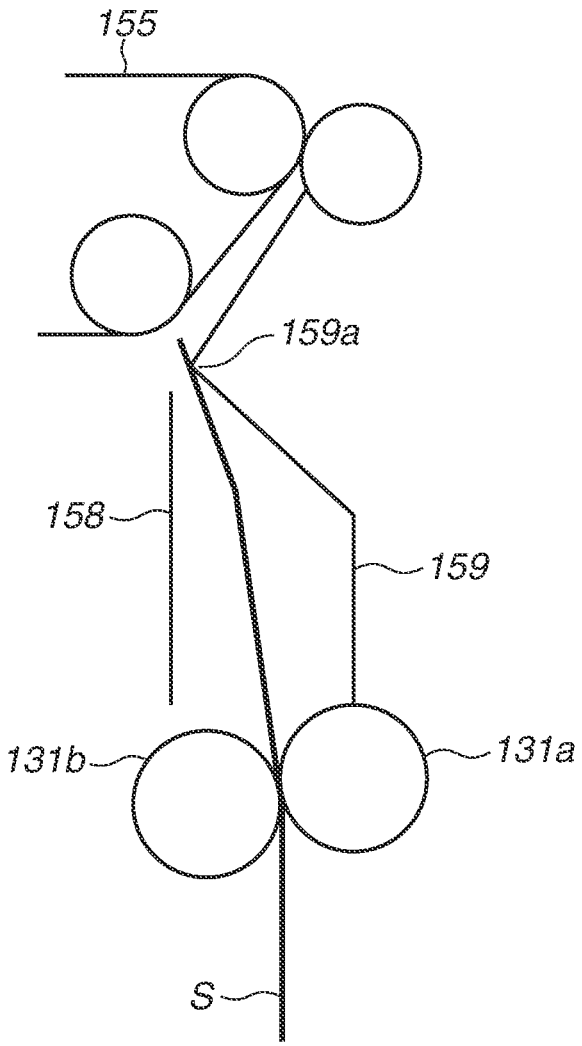
FIGS. 7A and 7B are schematic diagrams each illustrating sheet behavior in a cross-sectional direction in the bend portion.
Figure 7B:
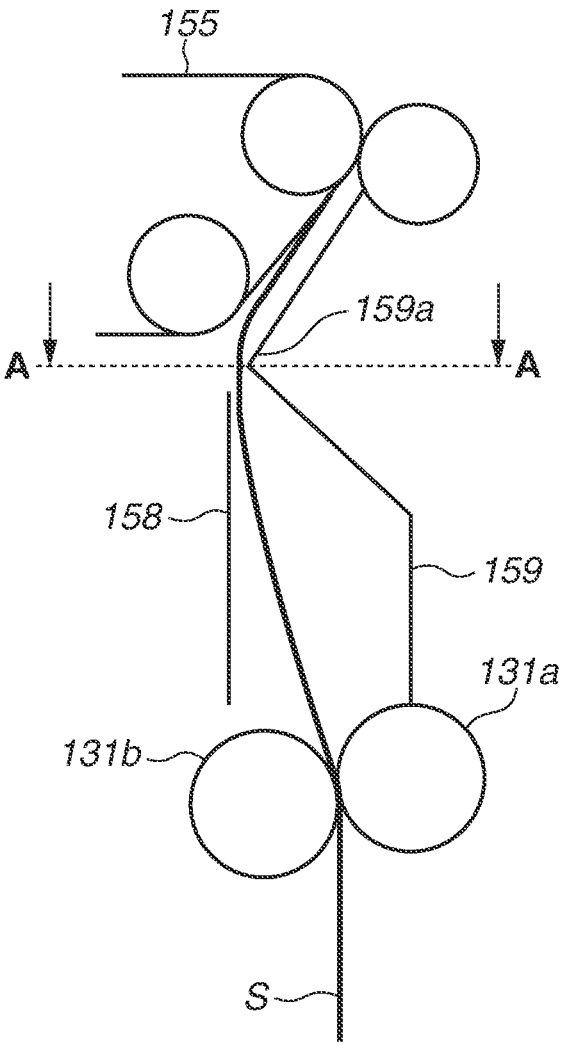

A mechanism for forming a wrinkle is described in detail with reference to FIGS. 7A, 7B, 8A, and 8B. FIGS. 7A and 7B are diagrams illustrating sheet behavior when the sheet S conveyed by the registration roller pair 131 is conveyed to the secondary transfer unit 156. FIG. 7A illustrates sheet behavior when the sheet S is conveyed in a direction toward the nip of the registration roller pair 131 and then the leading end of the sheet S is bent by coming into contact with the bend contact portion 159*a*. FIG. 7B illustrates sheet behavior when the leading end of the sheet S comes into contact with the intermediate transfer belt 155, and the sheet is bent at the bend contact portion 159*a* as a fulcrum.

When the sheet S is conveyed from a position illustrated in FIG. 7A to a position illustrated in FIG. 7B, the leading end of the sheet S is abruptly bent at the bend contact portion 159*a* as the fulcrum from the upper left to the upper right in FIGS. 7A and 7B. In this process, a wrinkle is likely to be formed in the sheet S depending on an orientation of the sheet S. The bend portion 200 as described above is necessary to maintain a stable sheet orientation at the time of image transfer in the secondary transfer unit 156.

Figure 8B:
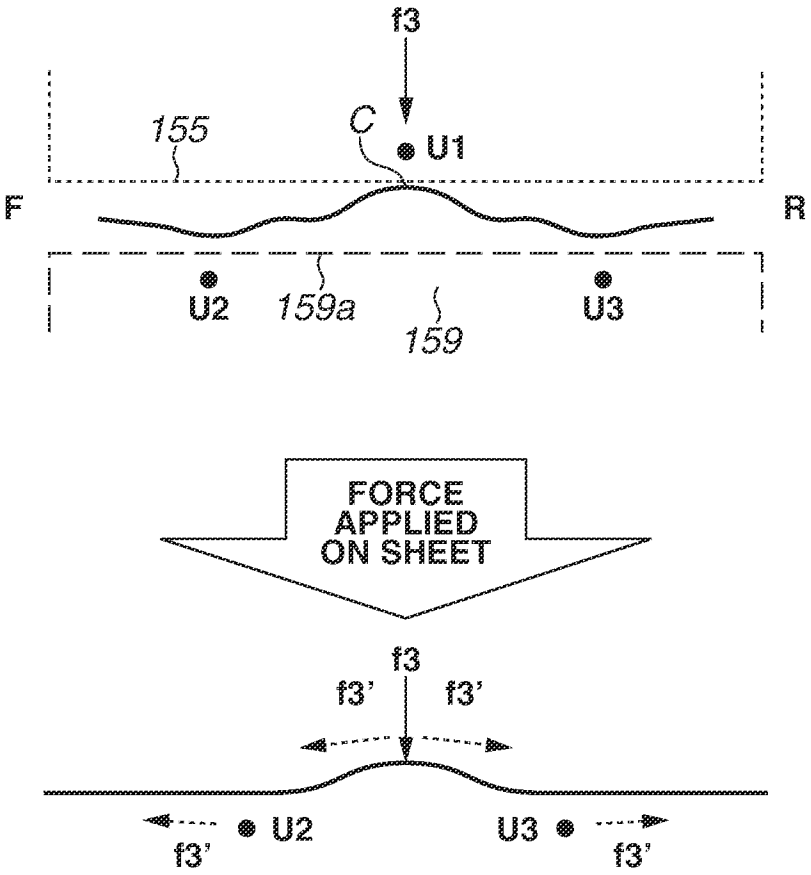
FIGS. 8A and 8B are schematic diagrams each illustrating sheet behavior in a width direction in the bend portion.
Figure 8A:
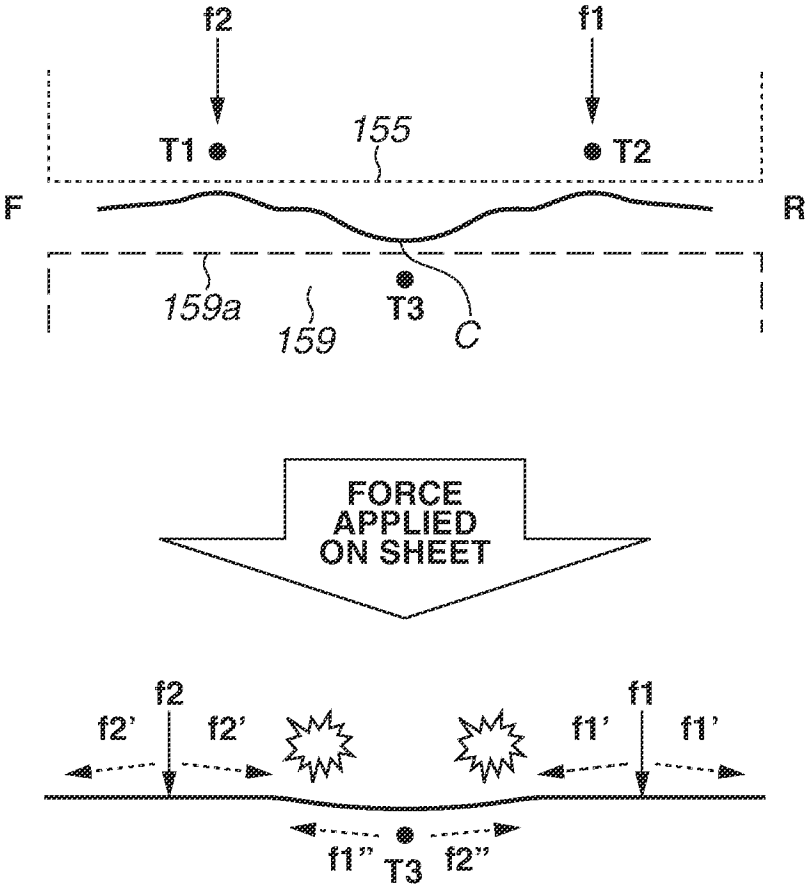

FIGS. 8A and 8B are schematic sectional views along the line A-A of FIG. 7B. FIG. 8A illustrates a case where a wave occurring in the sheet S is the wave crest C toward the bend inner guide 159 as similar to the cases illustrated in FIGS. 5A and 5B. FIG. 8B illustrates a case where a wave occurring in the sheet S is the wave crest C toward the bend outer guide 158 as similar to the cases illustrated in FIGS. 6A and 6B. In FIGS. 8A and 8B, reference letters F and R indicates a front side and a rear side of the image forming apparatus, respectively.

In FIG. 8A, a middle portion of the sheet S is warped toward the bend inner guide 159, and therefore if the leading end of the sheet S is bent by the intermediate transfer belt 155, the second surface of the sheet S comes into contact with the intermediate transfer belt 155 at two points (T1, t2) in a sheet width direction. In this state, the sheet S receives load forces f1 and f2 from the intermediate transfer belt 155. Meanwhile, the first surface of the sheet S comes into contact with the bend contact portion 159*a* at one point (T3) corresponding to a wave crest C of the sheet S. If the sheet S receives the load forces f1 and f2, each of component forces f1' and f2' by which the sheet S tends to extend in the width direction is applied on the sheet S. Accordingly, in a sheet contact portion T3 of the bend contact portion 159*a*, a load force f1' from the rear side (R side) is received, and a force f1" toward the front side (F side) is received. Meanwhile, a load force f2' from the front side is received, and a force f2" toward the rear side is received. As a result, the component force f2' interferes with the force f1" in the sheet S, and the component force f1' interferes with the force f2" in the sheet S. This causes a formation of wrinkle in the sheet S.

Meanwhile, in FIG. 8B, a middle portion of the sheet S is warped toward the bend outer guide 158, and therefore if the leading end of the sheet S is bent by the intermediate transfer belt 155, the second surface of the sheet S comes into contact with the intermediate transfer belt 155 at one point (U1) in the sheet width direction. In this state, the sheet S receives a load fore f3 from the intermediate transfer belt 155. Meanwhile, the first surface of the sheet S comes into contact with the bend contact portion 159*a* at two points (U2 and U3) corresponding to wave crests of the sheet S. If the sheet S receives the load force f3, a component force f3' by which the sheet S tends to extend in the width direction is applied on the sheet S. Accordingly, in a sheet contact portion U2 of the bend contact portion 159*a*, a load force f3' from the rear side is received and a force f3' toward the front side is received. Meanwhile, in a sheet contact portion U3 of the bend contact portion 159*a*, a load force 3' from the front side is received, and a force toward the rear side is received. Since the load force f3' is applied from a center portion of the sheet S to directions extending toward both end sides of the sheet, a wrinkle does not tend to be formed in the sheet S.

According to the present exemplary embodiment, as illustrated in FIG. 4, the sheet S conveyed by the registration roller pair 131 comes into contact with the protrusion 201 in the image area. Therefore, a wave crest is regulated toward the bend outer guide 158, and becomes a state as illustrated in FIG. 6A regardless of a state of a wave occurring between nips of the registration roller pair 131. Accordingly, the sheet S passes the protrusion 201 and is guided to the secondary transfer unit 156 without a wrinkle.

According to the present exemplary embodiment, the longer the width direction length of the protrusion 201 disposed in the image area, the effect on preventing wrinkles is great.

Moreover, the present exemplary embodiment has been described using an example case in which the registration roller pair 131 forms nip portions at two positions in the width direction. However, the present exemplary embodiment is not limited thereto. For example, the present exemplary embodiment can be applied to a case in which a plurality of nip portions at two or more positions is disposed in a width direction.

In the first exemplary embodiment as described above, the protrusion 201 is disposed in a section between the registration roller pair 131 and the protrusion 201 such that the sheet S comes into contact with the protrusion 201. Such arrangement controls a form of the wave occurring in the sheet S, and therefore formation of wrinkles in the sheet S can be reduced.

Figure 9:
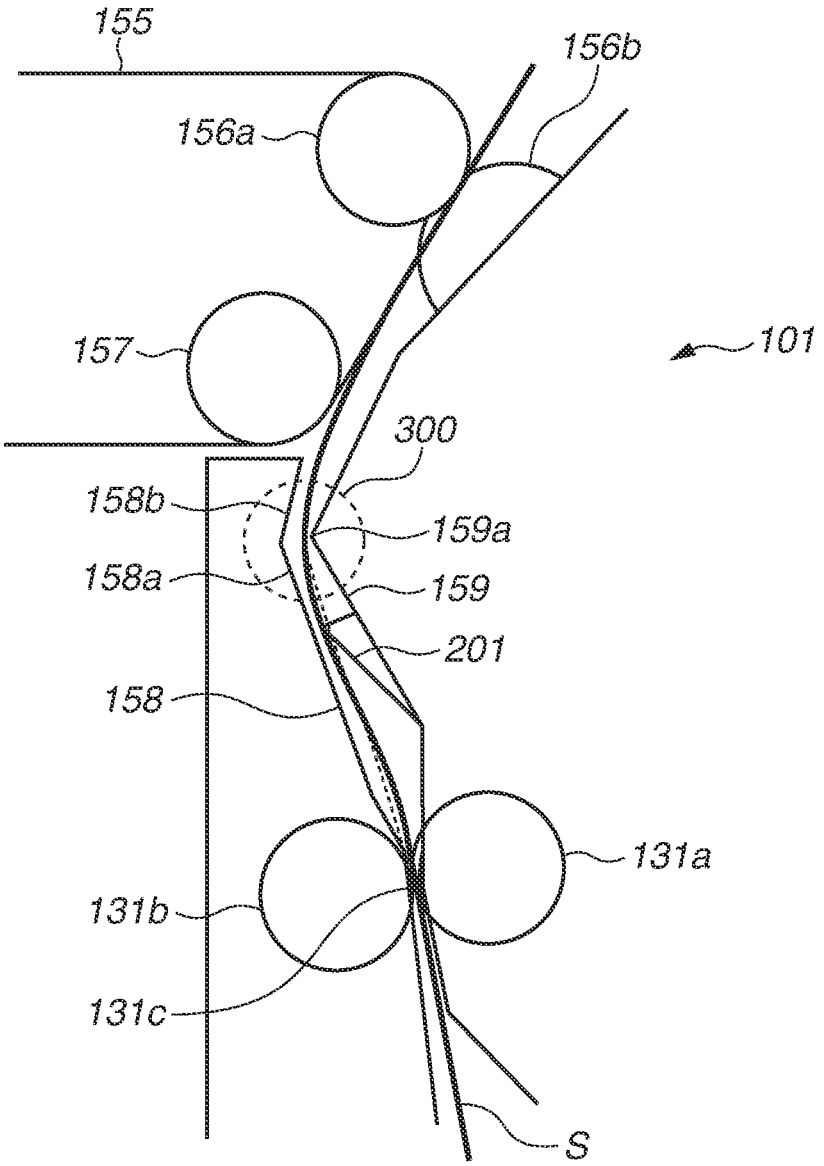
FIG. 9 is a schematic sectional view of a sheet conveyance device according to a second exemplary embodiment.

A sheet conveyance device 101 of a second exemplary embodiment includes a guide bend portion 300 formed by a conveyance guide as illustrated FIG. 9, instead of the bend portion 200 according to the first exemplary embodiment. Components similar to those of the sheet conveyance device 101 of the first exemplary embodiment are given the same reference numerals, and redundant descriptions thereof are omitted.

A bend outer guide 158 includes a first guide contact portion 158*a* and a second guide contact portion 158*b* disposed downstream from the first guide contact portion 158*a*. A bend contact portion 159*a* is disposed between the first guide contact portion 158*a* and the second guide contact portion 158*b* in a sheet conveyance direction. The guide bend portion 300 is formed by the first guide contact portion 158*a* and the second guide contact portion 158*b* of the bend outer guide 158 and the bend contact portion 159*a* of a bend inner guide 159.

As similar to the first exemplary embodiment, after an orientation of the sheet S is controlled by a protrusion 201, the sheet S passes the guide bend portion 300 and is stably guided to a secondary transfer unit 156. Therefore, formation of wrinkles in the sheet S can be reduced.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-090164, filed May 10, 2019, which is hereby incorporated by reference herein in its entirety.

What is claimed is:

1. A sheet conveyance device comprising:

a conveyance roller pair configured to convey a sheet;

a skew correction roller pair, disposed downstream from the conveyance roller pair in a sheet conveyance direction, wherein the skew correction roller pair is configured to form two nip portions disposed apart from each other in a width direction perpendicular to the sheet conveyance direction, and is configured to convey the sheet after a leading end of the conveyed sheet comes into contact with the two nip portions by the conveyance roller pair and a skew of the sheet is corrected in a state in which the skew correction roller pair is being stopped;

a transfer unit disposed downstream from the skew correction roller pair in the sheet conveyance direction and configured to transfer a toner image on the sheet and convey the sheet on which the toner image has been transferred;

a first conveyance guide, disposed between the skew correction roller pair and the transfer unit, wherein the first conveyance guide is configured to bend the sheet such that a first surface of the sheet becomes an inside surface, and wherein the first conveyance guide includes a bend contact portion configured to come into contact with a portion forming a bend on the first surface of the sheet;

a second conveyance guide disposed in a position facing the first conveyance guide and configured to bend the sheet with the first conveyance guide to cause the first surface of the sheet to be the inside surface such that a second surface opposite the first surface of the sheet is an outside surface; and a protrusion disposed between the skew correction roller pair and the bend contact portion and configured to come into contact with the first surface of the sheet, wherein the protrusion is disposed in an entire area between the two nip portions of the skew correction roller pair in the width direction, and wherein the protrusion protrudes toward the second conveyance guide from the first conveyance guide in a manner as to intersect with a straight line connecting the two nip portions and the bend contact portion in a cross section perpendicular to the width direction.

2. The sheet conveyance device according to claim 1, wherein the skew correction roller pair includes a drive roller configured to rotate, and a driven roller disposed opposite the drive roller and configured to be rotated, and wherein the driven roller is configured to be pressed toward the drive roller between the two nip portions in the width direction.

3. The sheet conveyance device according to claim 1, wherein the transfer unit includes:

an intermediate transfer belt configured to bear the toner image, a secondary transfer drive roller disposed on an inner circumferential surface of the intermediate transfer belt to stretch the intermediate transfer belt and configured to rotate the intermediate transfer belt, and a secondary transfer driven roller disposed in a position opposite the secondary transfer drive roller and configured to be urged toward the secondary transfer drive roller via the intermediate transfer belt.

4. The sheet conveyance device according to claim 1, further comprising, a bend portion configured to bend the sheet when the sheet is conveyed between the skew correction roller pair and the transfer unit, wherein the bend portion includes:

the bend contact portion of the first conveyance guide, a first guide contact portion that is disposed on an upstream side of the bend contact portion in the sheet conveyance direction and in which the second surface of the sheet comes into contact with the second conveyance guide, and a belt contact portion that is disposed on a downstream side of the bend contact portion in the sheet conveyance direction and in which the second surface of the sheet comes into contact with an intermediate transfer belt.

5. The sheet conveyance device according to claim 1, further comprising a bend portion configured to bend the sheet when the sheet is conveyed between the skew correction roller pair and the transfer unit, wherein the bend portion includes:

the bend contact portion of the first conveyance guide, a first guide contact portion that is disposed on an upstream side of the bend contact portion in the sheet conveyance direction and in which the second surface of the sheet comes into contact with the second conveyance guide, and a second guide contact portion that is disposed on a downstream side of the bend contact portion in the sheet conveyance direction and in which the second surface of the sheet comes into contact with the second conveyance guide.

6. An image forming apparatus comprising:

an image forming unit configured to form an image on a sheet; and the sheet conveyance device according to claim 1.

7. A method for a sheet conveyance device, wherein the sheet conveyance device includes a conveyance roller pair, a skew correction roller pair, disposed downstream from the conveyance roller pair in a sheet conveyance direction, a transfer unit disposed downstream from the skew correction roller pair in the sheet conveyance direction, a first conveyance guide having a bend contact portion and disposed between the skew correction roller pair and the transfer unit, a second conveyance guide disposed in a position facing the first conveyance guide, and a protrusion disposed between the skew correction roller pair and the bend contact portion, the method comprising:

conveying a sheet via the conveyance roller pair;

forming, via the skew correction roller pair, two nip portions disposed apart from each other in a width direction perpendicular to the sheet conveyance direction, and conveying, via the skew correction roller pair, the sheet after a leading end of the conveyed sheet comes into contact with the two nip portions by the conveyance roller pair and a skew of the sheet is corrected in a state in which the skew correction roller pair is being stopped;

transferring, via the transfer unit, a toner image on the sheet and convey the sheet on which the toner image has been transferred;

bending, via the first conveyance guide, the sheet such that a first surface of the sheet becomes an inside surface, and contacting, via the bend contact portion, a portion forming a bend on the first surface of the sheet;

bending, via a second conveyance guide the sheet with the first conveyance guide to cause the first surface of the sheet to be the inside surface such that a second surface opposite the first surface of the sheet is an outside surface, and contacting, via the protrusion, the first surface of the sheet, wherein the protrusion is disposed in an entire area between the two nip portions of the skew correction roller pair in the width direction, and wherein the protrusion protrudes toward the second conveyance guide from the first conveyance guide in a manner as to intersect with a straight line connecting the two nip portions and the bend contact portion in a cross section perpendicular to the width direction.

8. A non-transitory computer-readable storage medium storing a program to cause a computer to perform a method for a sheet conveyance device, wherein the sheet conveyance device includes a conveyance roller pair, a skew correction roller pair, disposed downstream from the conveyance roller pair in a sheet conveyance direction, a transfer unit disposed downstream from the skew correction roller pair in the sheet conveyance direction, a first conveyance guide having a bend contact portion and disposed between the skew correction roller pair and the transfer unit, a second conveyance guide disposed in a position facing the first conveyance guide, and a protrusion disposed between the skew correction roller pair and the bend contact portion, the method comprising:

conveying a sheet via the conveyance roller pair;

forming, via the skew correction roller pair, two nip portions disposed apart from each other in a width direction perpendicular to the sheet conveyance direction, and conveying, via the skew correction roller pair, the sheet after a leading end of the conveyed sheet comes into contact with the two nip portions by the conveyance roller pair and a skew of the sheet is corrected in a state in which the skew correction roller pair is being stopped;

transferring, via the transfer unit, a toner image on the sheet and convey the sheet on which the toner image has been transferred;

bending, via the first conveyance guide, the sheet such that a first surface of the sheet becomes an inside surface, and contacting, via the bend contact portion, a portion forming a bend on the first surface of the sheet;

bending, via a second conveyance guide the sheet with the first conveyance guide to cause the first surface of the sheet to be the inside surface such that a second surface opposite the first surface of the sheet is an outside surface, and contacting, via the protrusion, the first surface of the sheet, wherein the protrusion is disposed in an entire area between the two nip portions of the skew correction roller pair in the width direction, and wherein the protrusion protrudes toward the second conveyance guide from the first conveyance guide in a manner as to intersect with a straight line connecting the two nip portions and the bend contact portion in a cross section perpendicular to the width direction.

* * * * *